US011486164B2

(12) United States Patent
Zhang

(10) Patent No.: US 11,486,164 B2
(45) Date of Patent: Nov. 1, 2022

(54) INTELLIGENT LOCK GUARD DEVICE

(71) Applicant: Cytac Technology Limited, Shenzhen (CN)

(72) Inventor: Yong Zhang, Shenzhen (CN)

(73) Assignee: CYTAC TECHNOLOGY LIMITED, Shenzhen (CN)

( * ) Notice: Subject to any disclaimer, the term of this patent is extended or adjusted under 35 U.S.C. 154(b) by 506 days.

(21) Appl. No.: 16/660,826

(22) Filed: Oct. 23, 2019

(65) Prior Publication Data

US 2021/0040776 A1 Feb. 11, 2021

(30) Foreign Application Priority Data

Aug. 6, 2019 (CN) ..... 201910722022.1

(51) Int. Cl.

| | |
|---|---|
| ***E05B 47/02*** | (2006.01) |
| ***G07C 9/00*** | (2020.01) |
| ***E05G 1/00*** | (2006.01) |
| ***E05B 31/00*** | (2006.01) |
| ***E05B 47/00*** | (2006.01) |
| ***E05G 1/026*** | (2006.01) |

(52) U.S. Cl.

CPC ..... *E05B 47/026* (2013.01); *E05B 31/00* (2013.01); *E05B 47/0012* (2013.01); *E05G 1/005* (2013.01); *E05G 1/026* (2013.01); *G07C 9/00182* (2013.01); *G07C 9/00571* (2013.01); *E05B 2047/002* (2013.01); *E05B 2047/0017* (2013.01); *E05B 2047/0036* (2013.01)

(58) Field of Classification Search

CPC ..... E05B 31/00; E05B 47/0012; E05B 47/02; E05B 47/026; E05B 2047/0014; E05B 2047/0017; E05B 2047/0018; E05B 2047/002; E05B 2047/0036; E05B 2047/0094; E05B 2047/0095; E05B 65/52; E05B 65/5207; E05B 65/523; E05B 65/5238; E05B 65/5284; E05G 1/005; E05G 1/026; G07C 9/00174; G07C 9/00182; G07C 9/00309; G07C 9/00571; G07C 2009/00206

See application file for complete search history.

(56) References Cited

U.S. PATENT DOCUMENTS

| | | | | |
|---|---|---|---|---|
| 8,494,680 | B2 * | 7/2013 | Sparenberg | E05B 47/026 292/144 |
| 9,199,772 | B2 * | 12/2015 | Krippendorf | E05B 65/523 |
| 9,970,215 | B2 * | 5/2018 | Risi | E05B 47/0607 |
| 10,240,366 | B2 * | 3/2019 | Sotes Delgado | E05B 65/46 |

(Continued)

*Primary Examiner* — Christopher J Boswell

(57) ABSTRACT

An intelligent lock guard device, including a box body, the box body includes an upper box cover and a lower box body being buckled to form a hollow box body; the protection lock, including a lock catch and a lock body mechanism; the lock catch includes a fixing crossbeam and a locking rod, the fixing crossbeam is fixed on the upper box cover, and the locking rod is provided with a locking hole; the locking body mechanism, including a lock shaft, a toothed belt and a motor; the locking body mechanism is fixed on the lower box body; the lock shaft is provided with a lock cylinder convex bar, and the track of the toothed belt is parallel to the direction in which the lock cylinder convex bar is inserted or removed from the locking hole.

8 Claims, 9 Drawing Sheets

(56) References Cited

U.S. PATENT DOCUMENTS

| | | | | |
|---|---|---|---|---|
| 2004/0089038 | A1* | 5/2004 | Iijima | E05B 65/0864 70/257 |
| 2013/0014550 | A1* | 1/2013 | Xie | E05B 65/52 70/69 |
| 2018/0066453 | A1* | 3/2018 | Dobbins | E05B 47/0603 |
| 2018/0216377 | A1* | 8/2018 | Tran | E05B 65/0021 |
| 2020/0095807 | A1* | 3/2020 | Yasuda | E05B 65/5215 |
| 2020/0239207 | A1* | 7/2020 | Bontempo | E05B 65/5238 |
| 2022/0003021 | A1* | 1/2022 | Andreoli | E05B 65/0021 |

* cited by examiner

INTELLIGENT LOCK GUARD DEVICE

TECHNICAL FILED

The present application relates to a technical filed of protective equipment, in particular to an intelligent lock guard device.

BACKGROUND

Nowadays, people's awareness of anti-theft is getting stronger and stronger. Many personal items and valuables require special security equipment with anti-theft function. There is also a demand for security containment equipment with advanced anti-theft functions for the safe storage of valuables or personal items, as well as special items such as pistols for duty. The anti-theft protection function requires to be able to withstand protection including tamper-proof bars, double-impact locks, built-in hinges, new impact detection, etc., to prevent burglary and protect important items.

The traditional mechanical lock protection box protects the protection box from theft by mechanical lock. Many mechanical locks can not withstand the rods and lock impacting and so on. Many mechanical locks are mechanically locked on the outside of the box, which cause easy to be seen by others. Moreover, other people use unfair means to open the mechanical lock, and there is no alarm or reminder function. The owner of the protection box cannot know the state of the protection box, which may cause losses.

As a kind of movable carrying case, the suitcase has become one of the common tools in people's daily life. Currently, the suitcase on the market uses a manual mechanical lock to lock the box, or a mechanical lock protection box that uses a rotary code. The mechanical mechanism of the protection box is easily cracked by others, the protection effect is not high, and the user needs to manually lock the box or unlock the box, and the operation process is complicated. The anti-theft alarm function is not set in the existing protection box, and there is no anti-theft positioning function, so that the user cannot know the current state of the protection box at any time.

Therefore, how to provide a guard device with strong protection capability, convenient and quick use, and capable of viewing the state of the guard device at any time is a technical problem to be solved in the art.

SUMMARY

The object of the present application is to provide an intelligent lock guard device, which solves the technical problem that the protection device of the prior art has weak protection capability, complicated operation, and cannot view the state of the protection device at any time.

In order to achieve the above object, an intelligent lock guard device provided by the present application, comprising: a box body, a protection lock and a protection lock controller;

wherein the box body comprises an upper box cover and a lower box body, the upper box cover and the lower box body are buckled together to form a hollow box body; the upper box cover is connected to one side of the lower box body by a rotating shaft, and the other side of the lower box body opposite to the rotating shaft is connected by the protection lock;

the protection lock comprises a lock catch and a lock body mechanism; wherein the lock catch comprises a fixing crossbeam and a locking rod, the fixing crossbeam and the locking rod form a T-shape structure; and the fixing crossbeam is fixed on the upper box cover, the locking rod is provided with a locking hole;

the lock body mechanism comprises a lock shaft, a toothed belt and a motor; wherein the lock body mechanism is fixed on the lower box body and corresponds to a position of the lock catch; the lock shaft and the toothed belt form an L-shape transmission mechanism; a lock cylinder convex bar is disposed on the lock shaft, the lock cylinder convex bar is inserted into the locking hole to lock the box body, and the lock cylinder convex bar is able to move out from the locking hole to unlock the box body; the toothed belt is moved along a track of the toothed belt, wherein the track of the toothed belt is parallel to a direction in which the lock cylinder convex bar is inserted or removed from the locking hole; and a gear of the motor cooperates with the toothed belt, so as to drive the toothed belt to move by a rotation of the gear of the motor;

the protection lock controller is connected to the motor to receive a lock/unlock instruction, and controls the gear of the motor to drive the toothed belt to move in a direction of inserting into the locking hole/moving out from the locking hole.

Optionally, wherein the device further comprises a sensor connected to the protection lock controller, wherein the sensor is located on the lower box body, and a position of the sensor corresponds to a position of the fixing crossbeam; an upper cover opening information is generated and sent to the protection lock controller when the sensor senses that the upper cover moves open.

Optionally, wherein the protection lock controller comprises a protection lock control unit and a communication processing unit;

the protection lock control unit is connected to the motor and the communication processing unit to receive input and/or the lock/unlock instruction of the communication processing unit, control the gear of the motor to drive the toothed belt to move in a direction of inserting into/moving out from the locking hole;

the communication processing unit is connected to the protection lock control unit and the sensor, and is connected to a server through a wireless network; wherein information data of the server is received and transmitted to the protection lock control unit by the communication processing unit; information data of the sensor is received and transmitted to the server by the communication processing unit.

Optionally, wherein the protection lock controller further comprises a remote unlock processing unit, wherein the remote unlock processing unit is connected to the communication processing unit and the protection lock control unit, and remote unlocking information from the server forwarded by the processing unit is received by the remote unlock processing unit; and a corresponding remote unlocking instruction is generated according to the remote unlocking information, and the corresponding remote unlocking instruction is sent to the protection lock control unit.

Optionally, wherein the protection lock controller comprises a protection lock control unit and an alarm processing unit;

the protection lock control unit, connected to the motor and the alarm processing unit, is configured to receive the lock/unlock instruction and control the gear of the motor to drive the toothed belt to move in a direction of inserting into/moving out of the locking hole;

the alarm processing unit is connected to the protection lock control unit, and is configured to perform an alarm when the protection lock control unit does not receive the unlocking instruction and receives the upper cover opening information.

Optionally, wherein the lock body mechanism further comprises limiters, comprising a lock limiter and an unlock limiter, wherein the lock limiter and the unlock limiter are respectively located on two sides of the track of the toothed belt, and are connected to the protection lock controller;

a power-off instruction is generated to control the motor to stop rotating when the lock limiter or the unlock limiter detects that the toothed belt is moved to a locking limit position or a unlocking limit position.

Optionally, wherein the limiters are microswitches, wherein the microswitches are located at two sides of the track of the toothed belt and is connected to the protection lock controller; and the microswitches are activated when the lock shaft is moved to a locking limit position or an unlocking limit position to generate the power-off instruction, and the power-off instruction is sent to the protection lock controller to control the motor to stop rotating.

Optionally, wherein the protection lock controller comprises a protection lock control unit and an instruction processing unit;

the protection lock control unit is connected to the motor and the instruction processing unit, and is configured to receive the input and/or the lock/unlock instruction of the instruction processing unit, and is configured to control the gear of the motor to drive the toothed belt to move in the direction of inserting into the locking hole/moving out the locking hole;

the instruction processing unit is connected to the protection lock control unit, and is configured to receive input password information, and/or fingerprint information, and/or face information, and the input password information, and/or fingerprint information, and/or face information is respectively contrasted to pre-stored password information, and/or pre-stored fingerprint information, and/or pre-stored face information; the lock/unlock instruction is generated and sent to the protection lock control unit when contrasted information is consistent.

Optionally, wherein the device further comprises a locator connected to the protection lock controller, wherein the locator detects positioning information of the box body in real-time and sent to the protection lock controller; and the positioning information of the box body is sent to a server by the protection lock controller.

Optionally, wherein the device further comprises a battery, wherein the battery is connected to the protection lock controller and the motor to provide electrical power to the protection lock controller and the motor.

The advantageous effects achieved by the intelligent lock guard of the present application are as follows:

(1) e intelligent lock guard device provided by the present application controls the electric protection lock to lock or unlock the protection box through the protection lock controller, and the protection lock controller can receive remote, password input, and the locking or unlocking operation of fingerprint recognition and face recognition to generate an unlocking instruction to control the protection lock to lock or unlock the protection box. The protection lock structure is located inside the box body, the protection capability is strong, the electric control is convenient and quick to use, and the user can view the state of the guard device at any time, which is practical.

(2) The intelligent lock guard device provided by the present application controls the electric protection lock to lock or unlock the protection box through the protection lock controller, and transmits the positioning and other state information of the box to the server in real time and then sends it to the client for use. The client allows the user to view the status information of the box at any time. When needed, the user can remotely unlock the box through the client, which is convenient and quick. At the same time, the protection alarm function is also set up to alarm when the user is forced to open the box without authorization, and the behavior information of the stolen box is sent to the client, so that the user knows in time and improves the anti-theft effect of the box.

BRIEF DESCRIPTION OF THE DRAWINGS

In order to more clearly illustrate the embodiments of the present application or the technical solutions in the prior art, the drawings to be used in the embodiments or the prior art description will be briefly described below. It is obvious that the drawings in the following description are only part of the embodiments described in this application, and other drawings can be obtained by the skilled in the art according to these drawings.

DETAILED DESCRIPTION OF THE EMBODIMENTS

The technical solutions in the embodiments of the present application are clearly and completely described in the following with reference to the accompanying drawings in the embodiments of the present application. It is obvious that the described embodiments are a part of the embodiments of the present application, and not all of the embodiments. All other embodiments obtained by a person skilled in the art based on the embodiments of the present application without creative efforts are within the scope of the present application.

Embodiment 1

Figure 1:
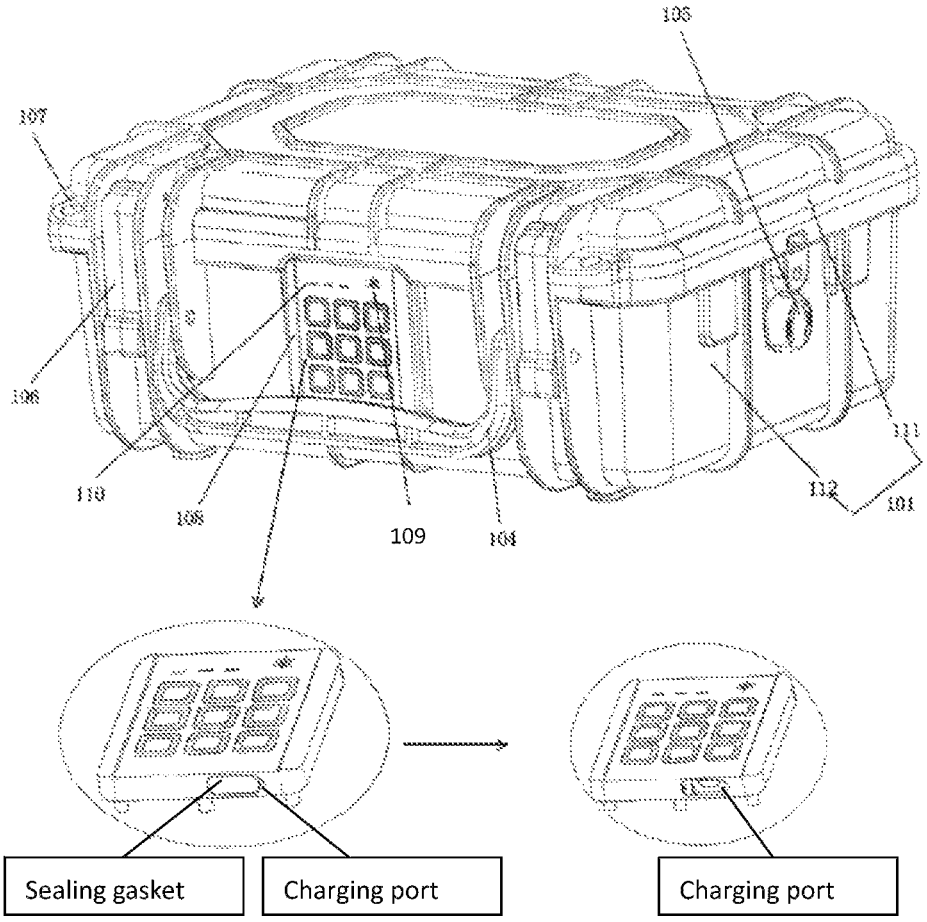
FIG. 1 is a schematic structural view of an intelligent lock guard device according to an embodiment of the present application.
Figure 2:
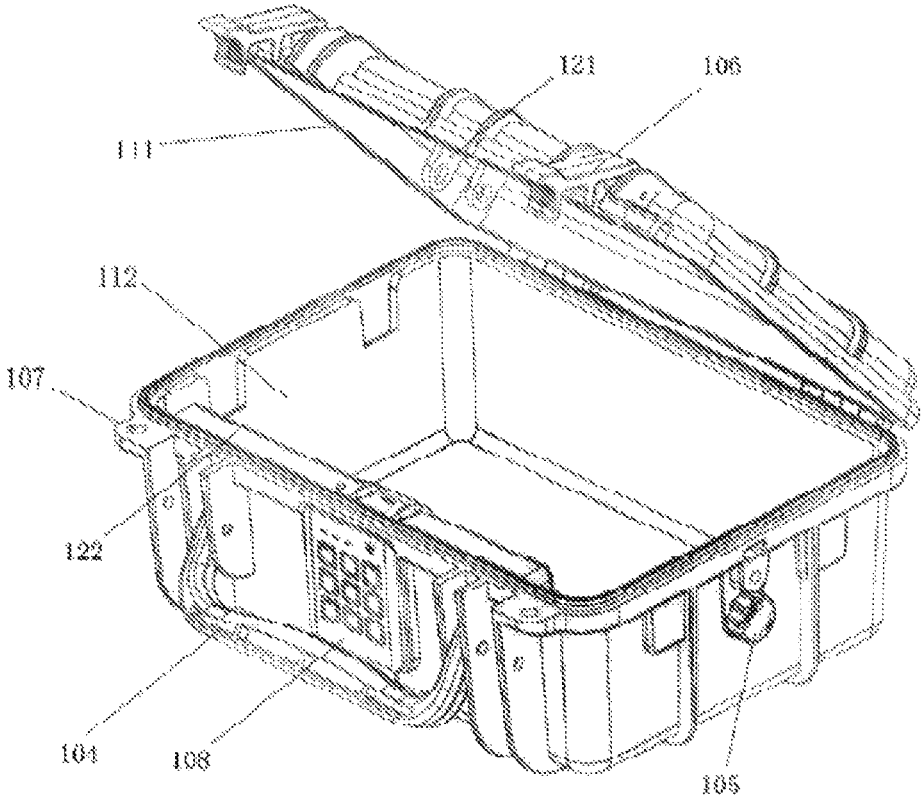
FIG. 2 is a schematic structural view showing the intelligent lock guard device of FIG. 1 in open state according to the embodiment.
Figure 3:
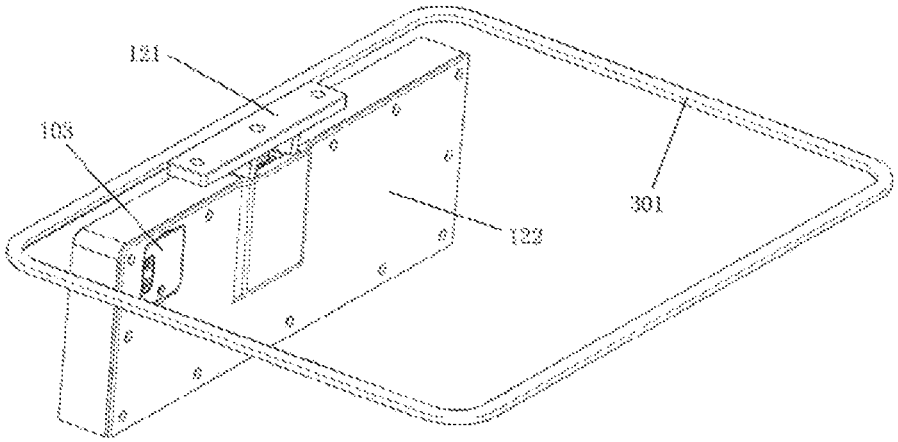
FIG. 3 is a schematic structural view of a protection lock and a box body sealing ring of the intelligent lock guard device of FIG. 1 according to an embodiment of the present application.
Figure 4:
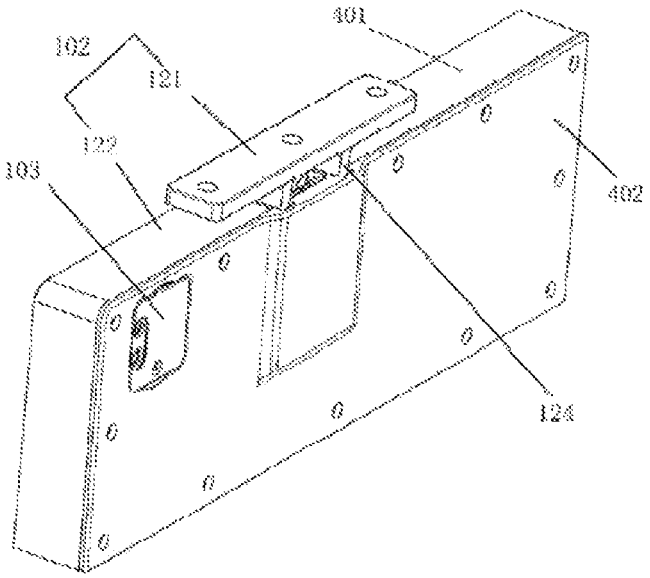
FIG. 4 is a schematic structural view of a protection lock of the intelligent lock guard device of FIG. 1 according to an embodiment of the present application.
Figure 5:
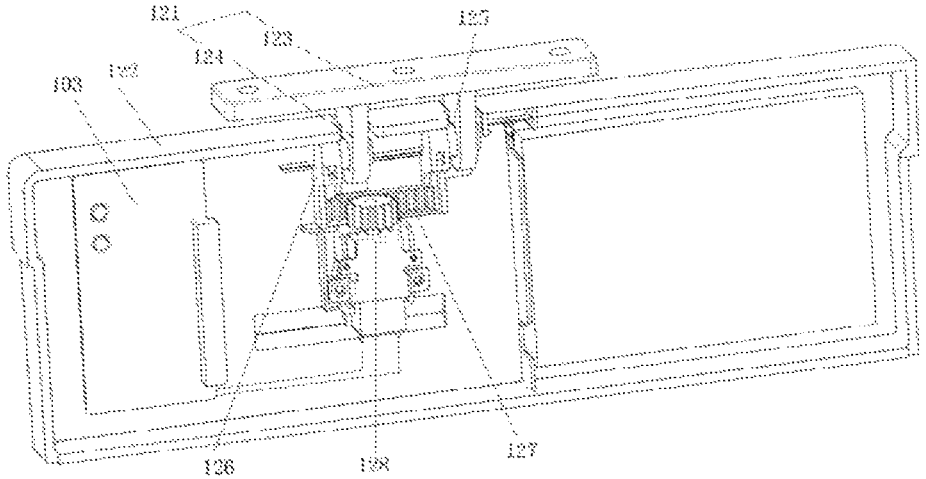
FIG. 5 is a schematic view showing the internal structure of a lock body mechanism of the intelligent lock guard device of FIG. 1 according to an embodiment of the present application.
Figure 6:
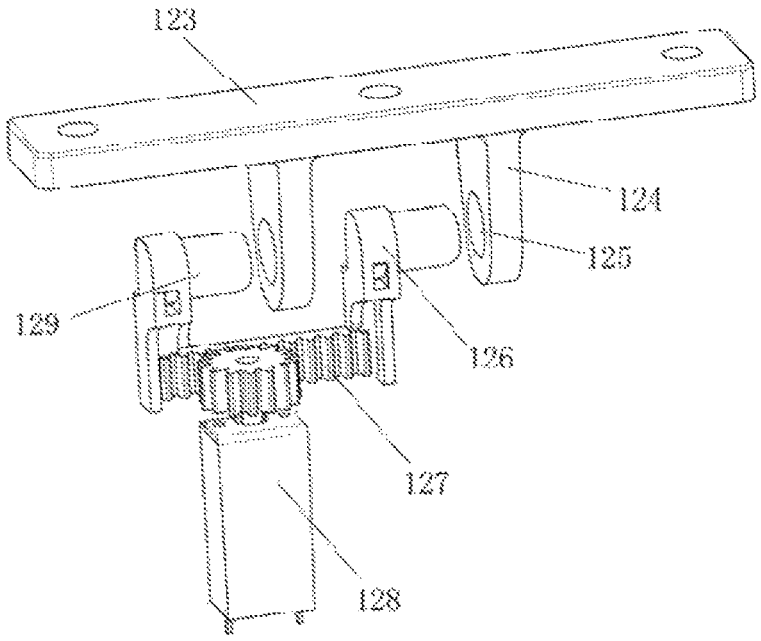
FIG. 6 is a schematic structural view of a transmission mechanism of the protection lock of the intelligent lock guard device of FIG. 1 according to an embodiment of the present application.

As shown in FIG. 1 to FIG. 5, FIG. 1 is a schematic structural view of an intelligent lock guard device according to the embodiment; FIG. 2 is a schematic structural view of the intelligent lock guard device of FIG. 1 in open state according to the embodiment; FIG. 3 is a structural schematic view of a protective lock and a box body sealing ring of the intelligent lock guard device according to the embodiment; FIG. 4 is a schematic structural view of the protection lock of the intelligent lock guard device of FIG. 1 according to the embodiment; FIG. 5 is a schematic structural view showing the internal structure of a lock body mechanism of the intelligent lock guard device of FIG. 1 according to an embodiment of the present application; FIG. 6 is a schematic structural view of a transmission mechanism of the protection lock of the intelligent lock guard device of FIG. 1 according to an embodiment of the present application. Specifically, the intelligent lock guard includes a box body 101, a protection lock 102, and a protection lock controller 103.

Wherein, the box body 101 includes an upper box cover 111 and a lower box body 112. The upper box cover and the lower box body are buckled to form a hollow box body. The upper box cover and one side of the lower box body are connected by a rotating shaft, and the other side opposite to the rotating shaft is connected by a protection lock. Optionally, a seal is made between the upper box cover 111 and the lower box body 112 by a sealing ring. The upper box cover are rotated around the rotating shaft to open or close the box, and the object can be accommodated in the hollow body of the box, and the rotating shaft can be a hinge shaft. Optionally, the upper cover and the lower box body are sealed by a sealing ring 301, as shown in FIG. 3.

Optionally, a handle 104 and a gas valve 105 may be disposed outside the box body 101 for carrying the protection box. A manual lock catch 106 and an locking hole 107 may be provided between the upper box cover 111 and the lower box body 112 for manually locking or fastening the upper box cover 111 and the lower box body 112 from the outside. A password button, an alarm 109, and a lock indicator light 110 may be provided in the code lock button frame 108 on the outside of the box body. The password button, the alarm 109, and the lock indicator light 110 are connected to the protection lock controller 103 and transmit communication information or control instructions to each other. The password lock compares the information of the user pressing the password button with the pre-stored preset password information. When the two match, an unlock instruction is generated and sent to the protection lock controller 103 to control the unlock operation. A charging port can also be set on the password lock. As shown in FIG. 1 and FIG. 2, the charging port can be a USB charging socket, which is connected to the power supply battery of the box body, and the battery is charged under the condition of connecting the external power source. When not charging, plug the charging port with a silicone sealing gasket to prevent foreign matter from entering the charging port.

As shown in FIG. 4, the protection lock 102 includes a lock catch 121 and a lock body mechanism 122. The lock catch 121 includes a fixing crossbeam 123 and a locking rod 124, and the fixing crossbeam 123 and the locking rod 124 form a T-shape structure. The fixing crossbeam 123 is fixed on the upper box cover 111, and the locking rod is provided with a locking hole 125.

The lock body mechanism 122 includes a lock shaft 126, a toothed belt 127 and a motor 128. The lock body mechanism 122 is fixed on the lower box body 112 and corresponds to the position of the lock catch 121. The lock shaft 126 and the toothed belt 127 form an L-shaped transmission mechanism. A lock cylinder convex bar 129 is disposed on the lock shaft 126. The lock cylinder convex bar 129 is inserted into the locking hole 125 to lock the box body, and the lock cylinder convex bar 129 is moved out of the locking hole 125 to unlock the box body. The toothed belt 127 moves along a track of the toothed belt, and the track of the toothed belt is parallel to the direction in which the lock cylinder convex bar is inserted into or removed from the locking hole. The gear of the motor 128 cooperates with the toothed belt 127, and the toothed belt is driven to move by the gear rotation of the motor. The lock body mechanism may include a lock body casing 401 and a lock body rear cover 402. The lock body rear cover is buckled to the lock body casing to form an accessory accommodation chamber together with the receiving cavity of the lock body casing, and the protection lock controller can pass through the lock body rear cover, and then is embedded and fixed in the receiving cavity of the lock body casing.

The protection lock controller 103 is connected to the motor 128 to receive a lock/unlock instruction, and controls the gear of the motor to drive the toothed belt to move in the direction of inserting into the locking hole/moving out from the locking hole. Optionally, the protection lock controller is further provided with a power button and a reset button for controlling activation or reset of the intelligent lock guard.

Figure 7:
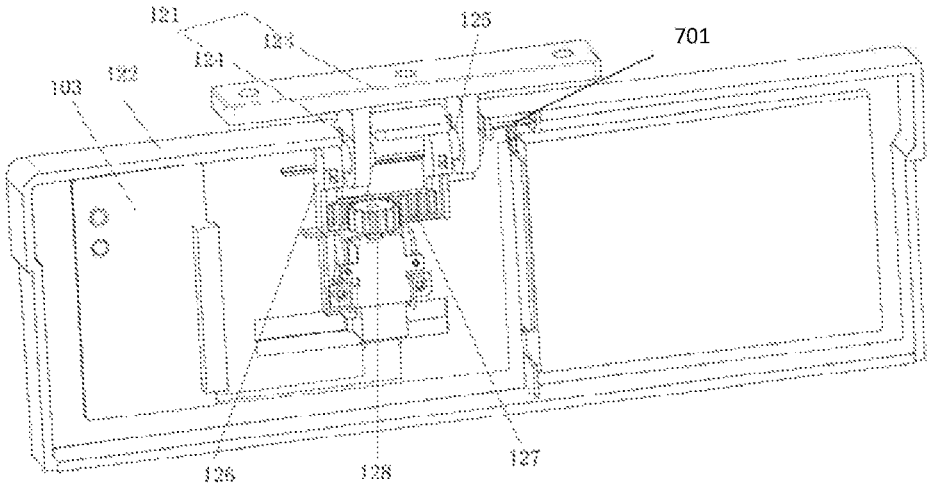
FIG. 7 is a schematic structural view of a second type of intelligent lock guard device according to an embodiment of the present application.
Figure 8:
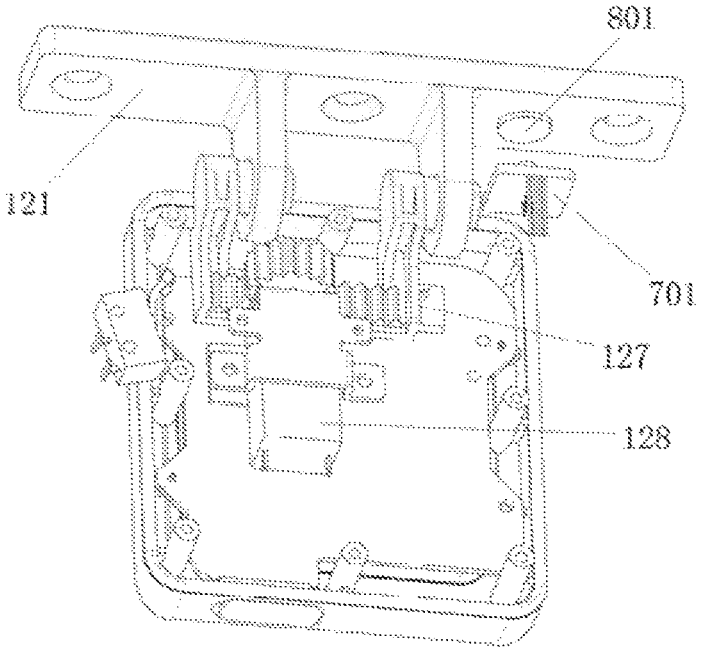
FIG. 8 is a schematic structural view of a sensor in a protection lock of the intelligent lock guard device of FIG. 7 according to an embodiment of the present application.

In some alternative embodiments, as shown in FIG. 7 and FIG. 8, FIG. 7 is a schematic structural view of a second type of intelligent lock guard device in the embodiment, and FIG. 8 is a schematic structural view of a sensor of the intelligent lock guard device in FIG. 7, what is different from that of FIG. 1 to FIG. 6 is that the device further includes a sensor 701, which is connected to the protection lock controller 103, and the sensor is located on the lower box body, and the position of the sensor is corresponding to the fixing crossbeam. When the sensor senses that the upper box cover moves open, an upper cover open information is generated and sent to the protection lock controller. An inductive detector 801 is disposed on the upper box cover corresponding to the sensor, and is matched with the sensor, and the inductive detector can also be set in the bottom of the fixing crossbeam corresponding to the sensor. Alternatively, the inductive detector can be a magnet that detects the distance between the sensor and the inductive detector. Or the sensor is a distance detector, and the distance between the upper box cover or the fixing crossbeam and the lock body mechanism can be detected by infrared rays or electromagnetic induction or the like.

Figure 9:
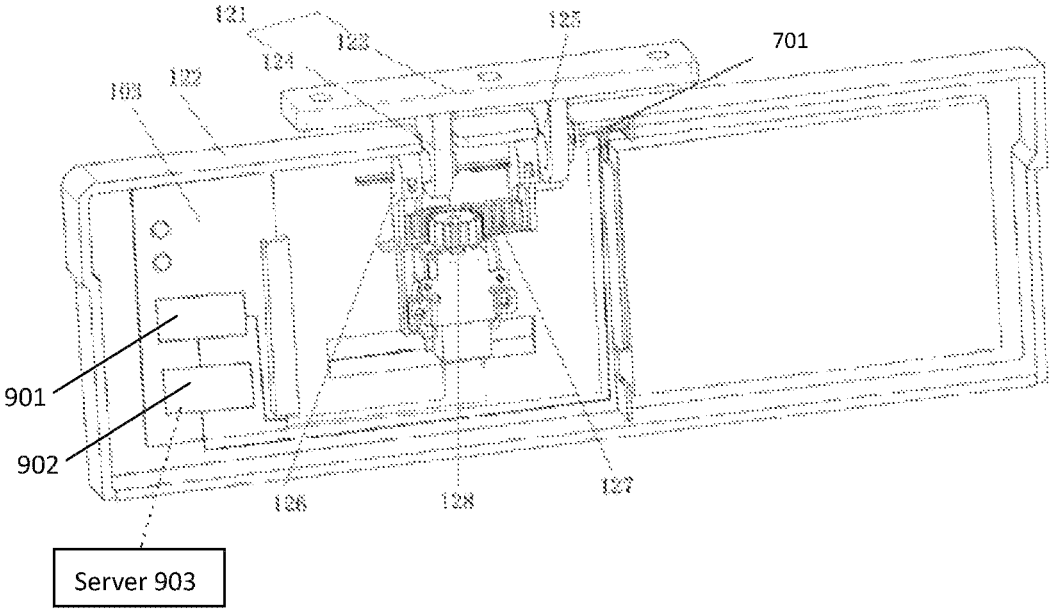
FIG. 9 is a schematic structural view of a third type of intelligent lock guard device according to an embodiment of the present application.

In some alternative embodiments, as shown in FIG. 9, the structure of the third type of intelligent lock guard in the present embodiment is different from that in FIG. 7, the protection lock controller 103 includes a protection lock control unit 901 and a communication processing unit 902.

Wherein, the protection lock control unit 901 is connected to the motor 128 and the communication processing unit 902, and the protection lock control unit 901 is configured to receive the input and/or the lock/unlock instruction of the communication processing unit, so as to control the gear of the motor to drive the toothed belt to move in the direction of inserting into the locking hole/moving out of the locking hole.

The communication processing unit 902 is connected to the protection lock control unit 901 and the sensor 701, and is connected to a server 903 through a wireless network. And the communication processing unit 902 is configured to receive the information data of the server and transmit the information to the protection lock control unit, and is also configured receive the information data of the sensor and transmit the information to the server 903.

Figure 10:
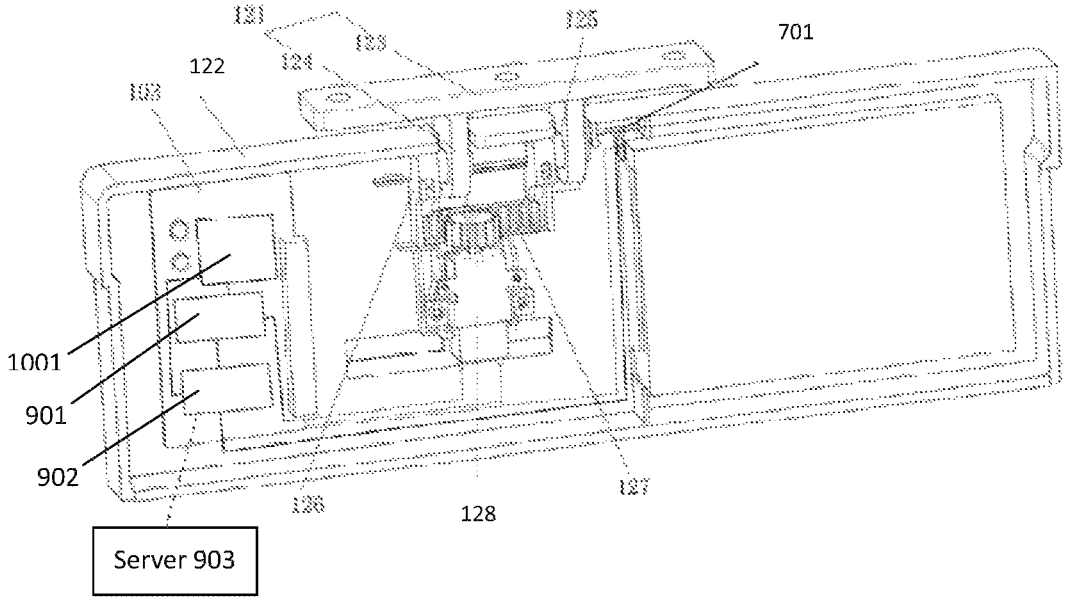
FIG. 10 is a schematic structural view of a fourth type of intelligent lock guard device according to an embodiment of the present application.

In some alternative embodiments, as shown in FIG. 10, FIG. 10 is a schematic structural view of a fourth type of intelligent lock guard in the present embodiment, and what is different from that of FIG. 9 is that the protection lock controller 103 in the device further includes the remote unlock processing unit 1001 is connected to the communication processing unit 902 and the protection lock control unit 901, and the remote unlock processing unit 1001 is configured to receive the remote unlocking information from the server 903 forwarded by the communication processing unit. A corresponding remote unlocking instruction is generated according to the remote unlocking information, and sent to the protection lock control unit.

Figure 11:
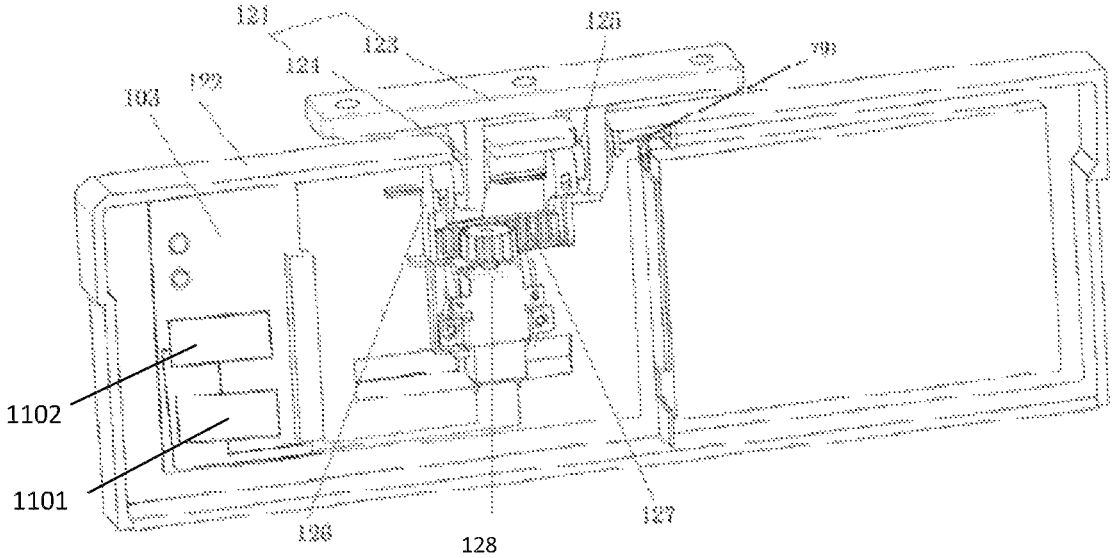
FIG. 11 is a schematic structural view of a fifth type of intelligent lock guard device according to an embodiment of the present application.

In some alternative embodiments, as shown in FIG. 11, FIG. 11 is a schematic structural view of a fifth type of intelligent lock guard device in the present embodiment, what is different from that in FIG. 7 is that the protection lock controller 103 of the device includes a protection lock control unit 1101 and an alarm processing unit 1102.

Wherein, the protection lock control unit 1101 is connected to the motor 128 and the alarm processing unit 1102, and receives the lock/unlock instruction, and controls the gear of the motor to drive the toothed belt to move in the direction of inserting into the locking hole/moving out of the locking hole.

The alarm processing unit 1102 is connected to the protection lock control unit 1101 and the sensor 701. When the protection lock control unit does not receive the unlock instruction and receives the upper cover open information, an alarm is issued.

Figure 12:
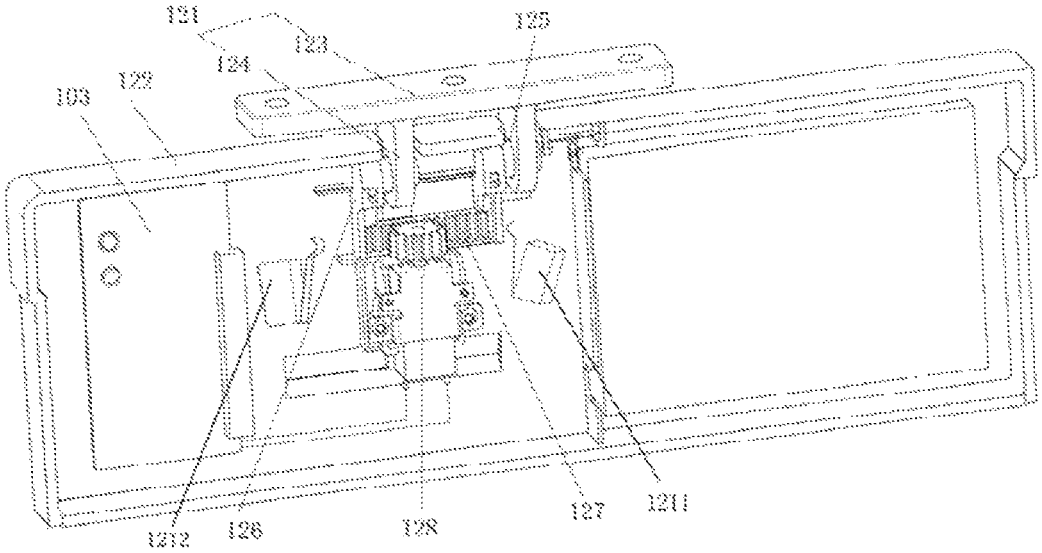
FIG. 12 is a schematic structural view of a sixth type of intelligent lock guard device according to an embodiment of the present application.

In some alternative embodiments, as shown in FIG. 12, FIG. 12 is a schematic structural view of the sixth type of intelligent lock guard device in the embodiment, what is different from that of FIGS. 1 to 6 is that the lock body mechanism 122 of the device further includes limiters, wherein the limiters include a lock limiter 1211 and an unlock limiter 1212, which are respectively located at two sides of the toothed belt track and connected to the protection lock controller 103.

When the lock limiter 1211 or the unlock limiter 1212 detects that the toothed belt moves to the lock limit position or the unlock limit position, a power-off instruction is generated, and the motor 128 is controlled to stop rotating by the protection lock controller 103.

Optionally, the limiters are microswitches located at two sides of the toothed belt track and connected to the protection lock controller. The microswitches are activated when the lock shaft is moved to the lock limit position or unlock limit position, so as to generate a power-off instruction, and send the power-off instruction to the protection lock controller to control the motor to stop rotating.

Figure 13:
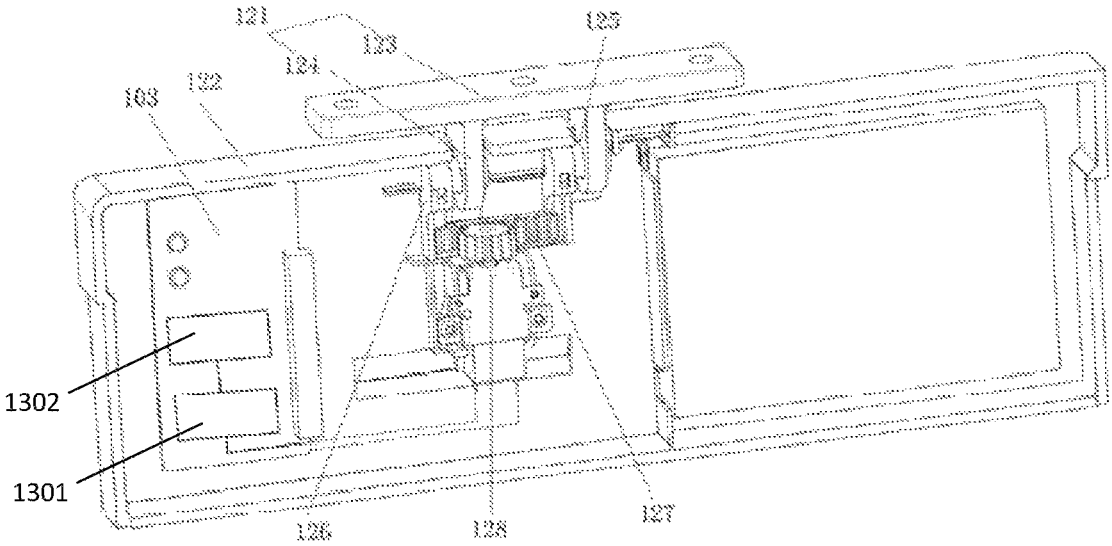
FIG. 13 is a schematic structural view of a seventh type of intelligent lock guard device according to an embodiment of the present application.

In some alternative embodiments, as shown in FIG. 13, FIG. 13 is a schematic structural view of a seventh type of intelligent lock guard in the embodiment, and what is different from FIG. 1 to FIG. 6 is that the protection lock controller 103 of the device includes a protection lock control unit 1301 and an instruction processing unit 1302.

Wherein, the protection lock control unit 1301 is connected to the motor 128 and the instruction processing unit 1302, and is configured to receive the input and/or the lock/unlock instruction of the instruction processing unit and control the gear of the motor to drive the toothed belt to move in a direction of inserting into the locking hole/moving out of the locking hole.

The instruction processing unit 1302 is connected to the protection lock control unit 1301, and receives input password information, and/or fingerprint information, and/or face information, respectively, and the input password information, and/or the fingerprint information, and/or the face information are contrasted to pre-stored pre-stored password information, and/or pre-stored fingerprint information, and/or pre-stored face information, respectively. When the comparison information is consistent, a lock/unlock instruction is generated and sent to the protection lock control unit.

Figure 14:
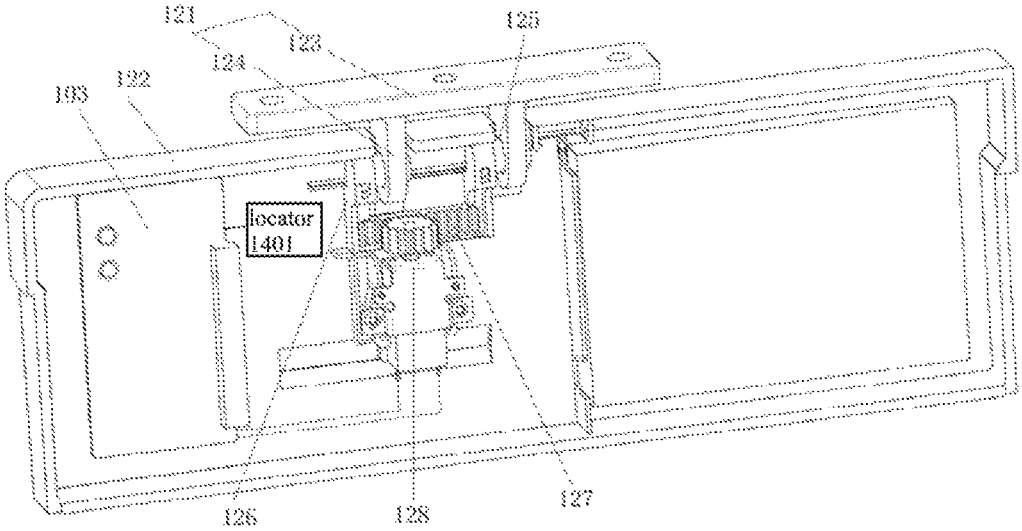
FIG. 14 is a schematic structural view of an eighth type of intelligent lock guard device according to an embodiment of the present application.

In some alternative embodiments, as shown in FIG. 14, FIG. 14 is a schematic structural view of a eighth type of intelligent lock guard in the embodiment, what is different from that of FIG. 1 to FIG. 6 is that the device further includes a locator 1401, which is connected to the protection lock controller 103. The locator is configured to detect the positioning information of the box in real-time and send it to the protection lock controller, and the positioning information is sent to the server through the protection lock controller. Alternatively, the locator can also be set within the protection lock controller.

Figure 15:
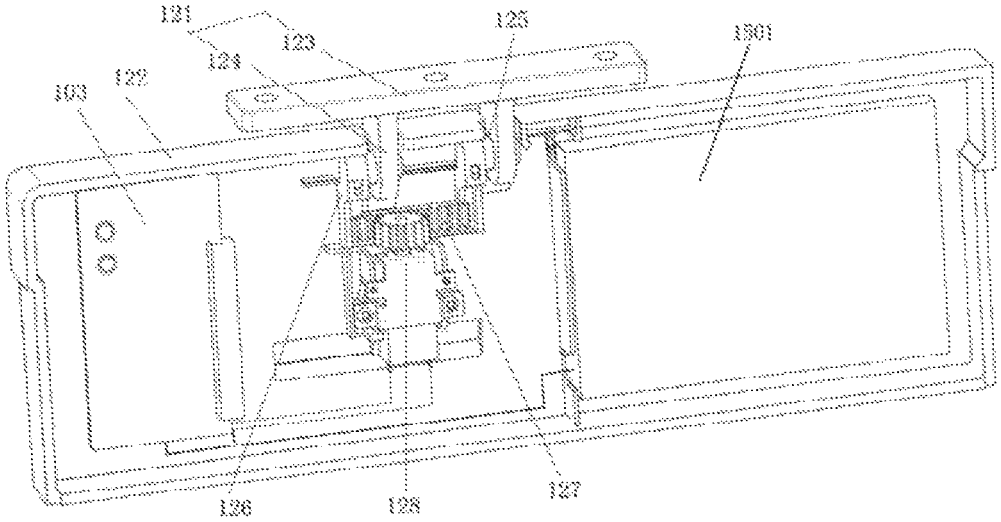
FIG. 15 is a schematic structural view of a ninth type of intelligent lock guard device according to an embodiment of the present application.

In some alternative embodiments, as shown in FIG. 15, FIG. 15 is a schematic structural view of a ninth type of intelligent lock guard in the embodiment, what is different from that of FIG. 1 to FIG. 6 is that the device further includes a battery 1501, which is connected to the protection lock controller 103 and the motor 128 for providing power to the protection lock controller and the motor. The battery can also be connected to the charging port of the intelligent lock guard device, and the battery can be charged by connecting an external power source through the charging port. The protection lock controller can monitor the remaining battery capacity in real-time, and send the remaining power status to the server for forwarding to the client for display to user, so as to remind the user to charge when the remaining power condition reaches or exceeds the preset remaining power threshold.

Figure 16:
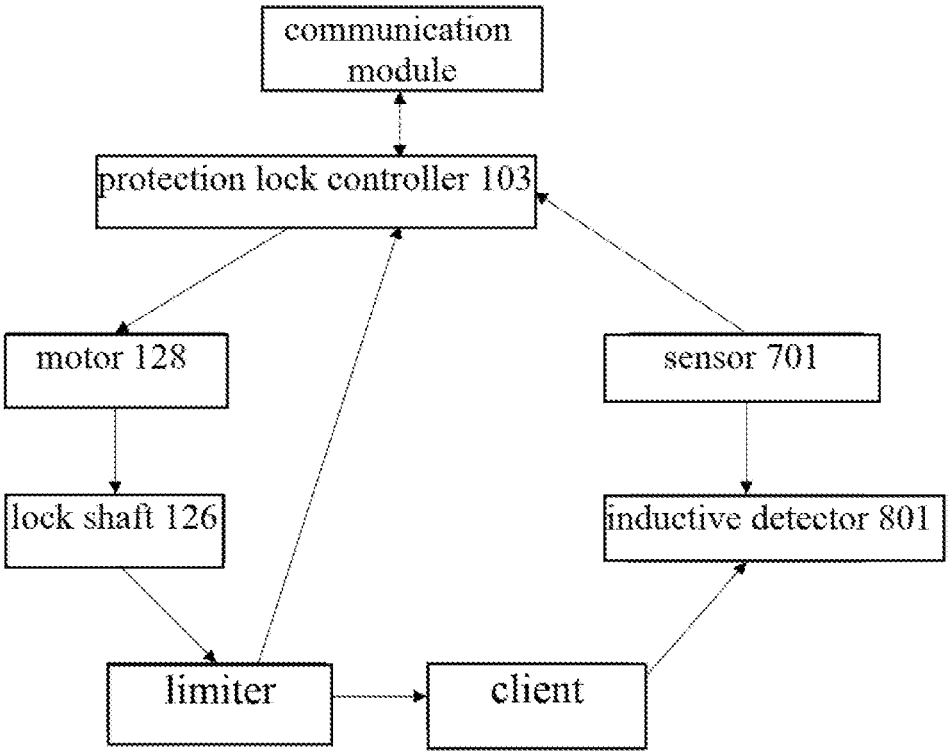
FIG. 16 is a schematic view showing the internal operations of a remotely interaction between an intelligent lock guard device and a client according to an embodiment of the present application.
Figure 17:
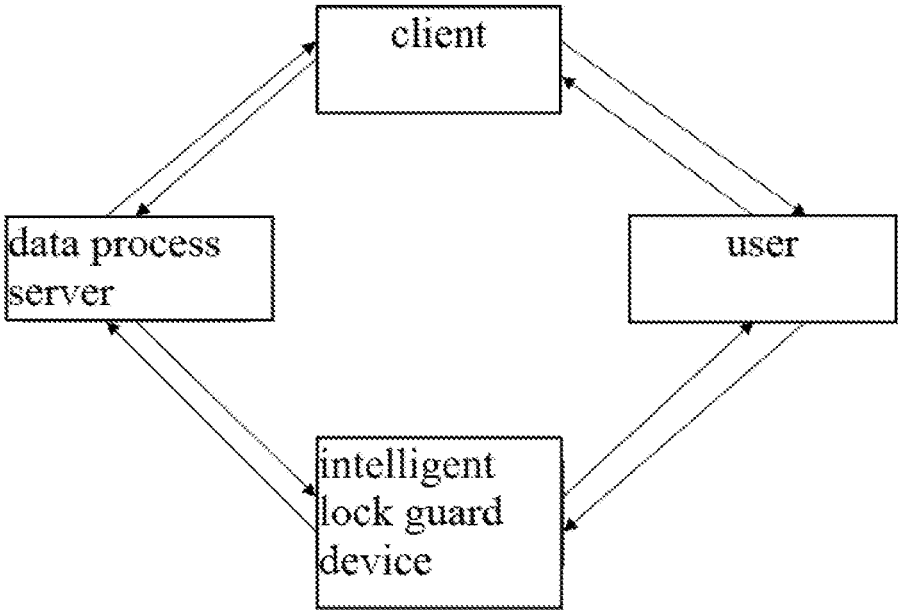
FIG. 17 is a schematic view showing the external operation of a remotely interaction between an intelligent lock guard device and a client according to an embodiment of the present application.

Optionally, as shown in FIG. 16 and FIG. 17, FIG. 16 is a schematic view of internal operation of the remote interaction between an intelligent lock guard device and a client in the embodiment. FIG. 17 is a schematic view of external operation of the remote interaction between an intelligent lock guard device and a client in the embodiment. Operating instructions for the intelligent lock guard device shown in FIG. 16 are as following: the communication module (such as the 4G signal module) on the protection lock controller receives the instruction from the client APP through the server transmission or password button (fingerprint recognition/face recognition), then recognizes the instruction, and then converts the instruction into a control signal to output the current to the motor. After the motor is rotated (there is gear on the motor), the gear on the motor drives the toothed belt on the lock shaft to move, moves to a certain distance, the lock shaft touches the microswitches when the toothed belt is moved to a certain distance, and then the microswitches are started, and the protection lock controller (PCB) receives the information and stops the current input. At this time, the upper box cover of the lock box is opened by the user, and the magnet movement of the upper box cover is sensed by the sensor of the lower case, and the information is sent to the protection lock controller, and the protection lock controller delivers the relevant instruction to the user (such as the indicator light flashes, the buzzer sounds, the APP receives the opened message, etc.). The external operating instructions for the intelligent lock guard device shown in FIG. 17 are as following: the real-time data (location information, power, device information, etc.) is uploaded to the sever by the intelligent lock guard device, and the uploaded real-time data are processed and transmitted to the mobile APP by the server for presentation to the user. The user can view the data of the intelligent lock guard device through the APP, and the user can send the instruction to the APP according to the needs of the user or the condition of the intelligent lock guard device after the user views the data. After receiving the user instruction, the instruction is transmitted to the server by the APP. The server receives the information transmitted by the APP and processes the information, and then sends an instruction to the intelligent lock guard device. The intelligent lock guard device can be unlocked by the user by manually inputting a password (plus fingerprint/face recognition). Therefore, the intelligent lock guard device has functions of positioning function, anti-theft function, and automatic unlock function.

The intelligent security technology of the intelligent lock guard is a highly interactive intelligent terminal experience. If needed, the user can easily use the available hotkeys and still maintain all other security functions. A rechargeable lithium-ion battery can provide at least 1 month of power and charge within 3 hours, including a micro USB charging device. The sophisticated interior includes a non-absorbent enclosed foam pad to protect the adjustment of the firearm and response to LED lighting, so that the user can view the safety content and the internal LED lights with adjustable brightness. Lightweight and high strength of the material: Made of advanced, impact-resistant polypropylene, used for exempt toughness and one-third of the weight of the steel box, (polypropylene plastic material referred to as PP), such as a hollow gun box of the intelligent lock protection device for placing duty guns is completely filled with foam to avoid scratching. The user can quickly access valuables, files and firearms from the automatically opened cover, and when it necessary, the user can quickly unlock it with the keyboard on the back. The intelligent lock guard device can be installed with three positioning methods (GPS, base station, WiFi) for positioning. The location and motion track of the lock box (real-time positioning) can be tracked and viewed through the mobile APP, so that intelligent interaction between the user and the intelligent lock guard device is improved, and realizes more convenient and quicker intelligent protection.

While the preferred embodiment of the present application has been described, it will be apparent that those skilled in the art can make further changes and modifications to the embodiments based on the basic creative concept. Therefore, the appended claims are intended to be interpreted as including the preferred embodiments and the modifications within the scope of the present application. It will be apparent to those skilled in the art that various modifications and changes can be made in the present application without departing from the spirit and scope of the application. Thus, if these modifications and variations of this application fall within the scope of the claims of this application, the application is also intended to include these modifications and variations.

What is claimed is:

1. An intelligent lock guard device; comprising: a box body, a protection lock and a protection lock controller; wherein the box body comprises an upper box cover and a lower box body, the upper box cover and the lower box body buckled together to form a hollow box body; the upper box cover connected to one side of the lower box body by a rotating shaft, and the other side of the lower box body opposite to the rotating shaft connected by the protection lock; the protection lock comprising a lock catch and a lock body mechanism; wherein the lock catch comprises a fixing crossbeam and a locking rod, both the fixing crossbeam and the locking rod formed a T-shape structure; and the fixing crossbeam fixed on the upper box cover, the locking rod provided with a locking hole; the lock body mechanism comprising a lock shaft, a toothed belt and a motor; wherein the lock body mechanism is fixed on the lower box body and corresponds to a position of the lock catch; the lock shaft and the toothed belt formed an L-shape transmission mechanism; a lock cylinder convex bar disposed on the lock shaft, the lock cylinder convex bar inserted into the locking hole to lock the box body, and the lock cylinder convex bar being able to move out from the locking hole to unlock the box body; the toothed belt moved along a track of the toothed belt, wherein the track of the toothed belt is parallel to a direction in which the lock cylinder convex bar is inserted or removed from the locking hole; and a gear of the motor cooperates with the toothed belt, so as to drive the toothed belt to move by a rotation of the gear of the motor; and the protection lock controller connected to the motor to receive a lock/unlock instruction, and controlling the gear of the motor to drive the toothed belt to move in a direction of inserting into the locking hole/moving out from the locking hole; and wherein the device further comprises a locator connected to the protection lock controller and configured to detect positioning information of the box body in real-time and-send the positioning information of the box body to the protection lock controller; and the positioning information of the box body sent to a server by the protection lock controller; and wherein the lock body mechanism further comprises limiters, the limiters comprising a lock limiter and an unlock limiter respectively located on two sides of the track of the toothed belt, and connected to the protection lock controller; a power-off instruction generated to control the motor to stop rotating when the lock limiter or the unlock limiter detects that the toothed belt is moved to a locking limit position or a unlocking limit position; and wherein the lock body mechanism further comprises a lock body casing and a lock body rear cover buckled to the lock body casing to form an accessory accommodation chamber together with the receiving cavity of the lock body casing, and the protection lock controller passing through the lock body rear cover, and then embedded and fixed in the receiving cavity of the lock body casing; and wherein the protection lock controller is further provided with a power button and a reset button for controlling activation or reset of the intelligent lock guard.

2. The intelligent lock guard device according to claim 1, wherein the device further comprises a sensor connected to the protection lock controller and located on the lower box body, and a position of the sensor corresponding to a position of the fixing crossbeam; an upper cover opening information generated and sent to the protection lock controller when the sensor senses that the upper cover moves open.

3. The intelligent lock guard device according to claim 2, wherein the protection lock controller comprises a protection lock control unit and a communication processing unit; the protection lock control unit connected to the motor and the communication processing unit to receive input and/or the lock/unlock instruction of the communication processing unit, control the gear of the motor to drive the toothed belt to move in, a direction of inserting into/moving out from the locking hole; and the communication processing unit connected to the protection lock control unit and the sensor, and connected to a server through a wireless network; wherein information data of the server is received and transmitted to the protection lock control unit by the communication processing unit; information data of the sensor is received and transmitted to the server by the communication processing unit.

4. The intelligent lock guard device according to claim 3, wherein the protection lock controller further comprises a remote unlock processing unit connected to the communication processing unit and the protection lock control unit, to receive remote unlocking information from the server forwarded by the processing unit; and a corresponding remote unlocking instruction generated according to the remote unlocking information and sent to the protection lock control unit.

5. The intelligent lock guard device according to claim 2, wherein the protection lock controller comprises a protection lock control unit and an alarm processing unit; the protection lock control unit connected to the motor and the alarm processing unit and configured to receive the lock/unlock instruction and control the gear of the motor to drive the toothed belt to move in a direction of inserting into/moving out of the locking hole; the alarm processing unit connected to the protection lock control unit, and configured to perform an alarm when the protection lock control unit does not receive the unlocking instruction and receives the upper cover opening information.

6. The intelligent lock guard device according to claim 1, wherein the limiters are microswitches located at two sides of the track of the toothed belt and connected to the protection lock controller; and wherein the microswitches are activated when the lock shaft is moved to a locking limit position or an unlocking limit position to generate the power-off instruction, and the power-off instruction is sent to the protection lock controller to control the motor to stop rotating.

7. The intelligent lock guard device according to claim 1, wherein the protection lock controller comprises a protection lock control unit and an instruction processing unit; the protection lock control unit connected to the motor and the instruction processing unit, and configured to receive the input and/or the lock/unlock instruction of the instruction processing unit, and control the gear of the motor to drive the toothed belt to move in the direction of inserting into the locking hole/moving out the locking hole; the instruction processing unit connected to the protection lock control unit, and configured to receive input password information, and/or fingerprint information, and/or face information, the input password information, and/or fingerprint information, and/or face information respectively contrasted to pre-stored password information, and/or pre-stored fingerprint information, and/or pre-stored face information; the lock/unlock instruction generated and sent to the protection lock control unit when, contrasted information is consistent.

8. The intelligent lock gird device according to claim 1, wherein the device further comprises a battery connected to the protection lock controller and the motor to provide electrical power to the protection lock controller and the motor.

* * * * *